US005095001A

United States Patent [19]

Miles et al.

[11] Patent Number: 5,095,001

[45] Date of Patent: Mar. 10, 1992

[54] RECEIVER SHEET

[75] Inventors: Isabel S. Miles, Swainby; Gary V. Rhoades, Eaglescliffe; Moray W. Mackenzie, Yarm, all of England

[73] Assignee: Imperial Chemical Industries PLC, London, England

[21] Appl. No.: 510,889

[22] Filed: Apr. 18, 1990

[30] Foreign Application Priority Data

Apr. 24, 1989 [GB] United Kingdom ..... 8909250

[51] Int. Cl.[5] ..... B41M 5/035; B41M 5/26

[52] U.S. Cl. ..... 503/227; 8/471; 427/146; 427/152; 428/195; 428/412; 428/480; 428/910; 428/913; 428/914

[58] Field of Search ..... 8/471; 428/195, 913, 428/914, 412, 480, 910; 503/227; 427/146, 152

[56] References Cited

FOREIGN PATENT DOCUMENTS 0144247 6/1985 European Pat. Off. ..... 503/227

60-19138 1/1985 Japan ..... 503/227

*Primary Examiner*—Bruce H. Hess

*Attorney, Agent, or Firm*—Cushman, Darby & Cushman

[57] ABSTRACT

A thermal transfer printing receiver sheet for use in association with a compatible donor sheet comprises a supporting substrate having a dye-receptive receiving layer, said dye receiving layer comprises a dye-receptive polymer and from 0.5 to 30% by weight of the layer of at least one antiplasticizer therefor.

8 Claims, 1 Drawing Sheet

RECEIVER SHEET

BACKGROUND OF THE INVENTION (a) Technical Field of Invention

This invention relates to thermal transfer printing and, in particular, to a thermal transfer printing receiver sheet for use with an associated donor sheet.

(b) Background of the Art

Currently available thermal transfer printing (TTP) techniques generally involve the generation of an image on a receiver sheet by thermal transfer of an imaging medium from an associated donor sheet. The donor sheet typically comprises a supporting substrate of paper, synthetic paper or a polymeric film material coated with a transfer layer comprising a sublimable dye incorporated in an ink medium usually comprising a wax and/or a polymeric resin binder. The associated receiver sheet usually comprises a supporting substrate, of a similar material, having on a surface thereof a dye-receptive, polymeric receiving layer. When an assembly, comprising a donor and a receiver sheet positioned with the respective transfer and receiving layers in contact, is selectively heated in a patterned area derived, for example—from an information signal, such as a television signal, dye is transferred from the donor sheet to the dye-receptive layer of the receiver sheet to form therein a monochrome image of the specified pattern. By repeating the process with different monochrome dyes, a full coloured image is produced on the receiver sheet.

To facilitate separation of the imaged sheet from the heated assembly, at least one of the transfer layer and receiving layer may be associated with a release medium, such as a silicone oil.

Although the intense, localised heating required to effect development of a sharp image may be applied by various techniques, including laser beam imaging, a convenient and widely employed technique of thermal printing involves a thermal print-head, for example, of the dot matrix variety in which each dot is represented by an independent heating element (electronically controlled, if desired). A problem associated with such a contact print-head is the deformation of the receiver sheet resulting from pressure of the respective elements on the heated, softened assembly. This deformation manifests itself as a reduction in the surface gloss of the receiver sheet, and is particularly significant in receiver sheets the surface of which is initially smooth and glossy, i.e. of the kind which is in demand in the production of high quality art-work. A further problem associated with pressure deformation is the phenomenon of "strike-through" in which an impression of the image is observed on the rear surface of the receiver sheet, i.e. the free surface of the substrate remote from the receiving layer.

The commercial success of a TTP system depends, inter alia, on the development of an image having adequate intensity, contrast and definition. Optical density of the image is therefore an important criterion, and is dependent, inter alia, upon the glass transition temperature (Tg) of the receiving layer. High optical density can be achieved with receiving layers comprised of polymers having a low Tg. Practical handling difficulties limit the range of low Tg polymers which can be utilised in TTP applications. For example the receiving layer must not be sticky. In addition, ageing of the image occurs, the rate of which is also dependent upon the Tg of the polymeric receiving sheet. Unfortunately the lower the Tg the greater the rate of ageing. Ageing of the image manifests itself as a reduction in the optical density and is due, inter alia, to diffusion of the dye to the surface of the receiver sheet, where crystallisation of the dye occurs.

(c) The Prior Art

Various receiver sheets have been proposed for use in TTP processes. For example, EP-A-0133012 discloses a heat transferable sheet having a substrate and an image-receiving layer thereon, a dye-permeable releasing agent, such as silicone oil, being present either in the image-receiving layer, or as a release layer on at least part of the image-receiving layer. Materials identified for use in the substrate include condenser paper, glassine paper, parchment paper, or a flexible thin sheet of a paper or plastics film (including polyethylene terephthalate) having a high degree of sizing, although the exemplified substrate material is primarily a synthetic paper—believed to be based on a propylene polymer. The thickness of the substrate is ordinarily of the order of 3 to 50 μm. The image-receiving layer may be based on a resin having an ester, urethane, amide, urea, or highly polar linkage.

Related European patent application EP-A-0133011 discloses a heat transferable sheet based on similar substrate and imaging layer materials save that the exposed surface of the receptive layer comprises first and second regions respectively comprising (a) a synthetic resin having a glass transition temperature of from −100° to 20° C. and having a polar group, and (b) a synthetic resin having a glass transition temperature of 40° C. or above. The receptive layer may have a thickness of from 3 to 50 μm when used in conjunction with a substrate layer, or from 60 to 200 μm when used independently.

As hereinbefore described, problems associated with commercially available TTP receiver sheets include inadequate intensity and contrast of the developed image, and fading of the image on storage.

We have now devised a receiver sheet for use in a TTP process which overcomes or substantially eliminates the aforementioned defects.

SUMMARY OF THE INVENTION

Accordingly, the present invention provides a thermal transfer printing receiver sheet for use in association with a compatible donor sheet, the receiver sheet comprising a supporting substrate having, on at least one surface thereof, a dye-receptive receiving layer to receive a dye thermally transferred from the donor sheet, wherein the receiving layer comprises a dye-receptive polymer and from 0.5% to 30% by weight of the layer of at least one antiplasticiser therefor.

The invention also provides a method of producing a thermal transfer printing receiver sheet for use in association with a compatible donor sheet, comprising forming a supporting substrate having, on at least one surface thereof, a dye-receptive receiving layer to receive a dye thermally transferred from the donor sheet, wherein the receiving layer comprises a dye-receptive polymer and from 0.5% to 30% by weight of the layer of at least one antiplasticiser therefor.

DETAILED DESCRIPTION AND PREFERRED EMBODIMENTS OF THE INVENTION

In the context of the invention the following terms are to be understood as having the meanings hereto assigned:

sheet: includes not only a single, individual sheet, but also a continuous web or ribbon-like structure capable of being sub-divided into a plurality of individual sheets.

compatible: in relation to a donor sheet, indicates that the donor sheet is impregnated with a dyestuff which is capable of migrating, under the influence of heat, into, and forming an image in, the receiving layer of a receiver sheet placed in contact therewith.

opaque: means that the substrate of the receiver sheet is substantially impermeable to visible light.

voided: indicates that the substrate of the receiver sheet comprises a cellular structure containing at least a proportion of discrete, closed cells.

film: is a self-supporting structure capable of independent existence in the absence of a supporting base.

antistatic: means that a receiver sheet treated by the application of an antistatic layer exhibits a reduced tendency, relative to an untreated sheet, to accumulate static electricity at the treated surface.

The substrate of a receiver sheet according to the invention may be formed from paper, but preferably from any thermoplastics, film-forming, polymeric material. Suitable materials include a homopolymer or a copolymer of a 1-olefin, such as ethylene, propylene or butene-1, a polyamide, a polycarbonate, and particularly a synthetic linear polyester which may be obtained by condensing one or more dicarboxylic acids or their lower alkyl (up to 6 carbon atoms) diesters, e.g. terephthalic acid, isophthalic acid, phthalic acid, 2,5-, 2,6-, or 2,7-naphthalenedicarboxylic acid, succinic acid, sebacic acid, adipic acid, azelaic acid, 4,4'-diphenyldicarboxylic acid, hexahydroterephthalic acid or 1,2-bis-p-carboxyphenoxyethane (optionally with a monocarboxylic acid, such as pivalic acid) with one or more glycols, particularly aliphatic glycols, e.g. ethylene glycol, 1,3-propanediol, 1,4-butanediol, neopentyl glycol and 1,4-cyclohexanedimethanol. A polyethylene terephthalate film is particularly preferred, especially such a film which has been biaxially oriented by sequential stretching in two mutually perpendicular directions, typically at a temperature in the range 70° to 125° C., and preferably heat set, typically at a temperature in the range 150° to 250° C., for example—as described in British patent 838708.

A film substrate for a receiver sheet according to the invention may be uniaxially oriented, but is preferably biaxially oriented by drawing in two mutually perpendicular directions in the plane of the film to achieve a satisfactory combination of mechanical and physical properties. Formation of the film may be effected by any process known in the art for producing an oriented polymeric film—for example, a tubular or flat film process.

In a tubular process, simultaneous biaxial orientation may be effected by extruding a thermoplastics polymeric tube which is subsequently quenched, reheated and then expanded by internal gas pressure to induce transverse orientation, and withdrawn at a rate which will induce longitudinal orientation.

In the preferred flat film process a film-forming polymer is extruded through a slot die and rapidly quenched upon a chilled casting drum to ensure that the polymer is quenched to the amorphous state. Orientation is then effected by stretching the quenched extrudate in at least one direction at a temperature above the glass transition temperature of the polymer. Sequential orientation may be effected by stretching a flat, quenched extrudate firstly in one direction, usually the longitudinal direction, ie the forward direction through the film stretching machine, and then in the transverse direction. Forward stretching of the extrudate is conveniently effected over a set of rotating rolls or between two pairs of nip rolls, transverse stretching then being effected in a stenter apparatus. Stretching is effected to an extent determined by the nature of the film-forming polymer, for example—a polyester is usually stretched so that the dimension of the oriented polyester film is from 2.5 to 4.5 its original dimension in the, or each, direction of stretching.

A stretched film may be, and preferably is, dimensionally stabilised by heat-setting under dimensional restraint at a temperature above the glass transition temperature of the film-forming polymer but below the melting temperature thereof, to induce crystallisation of the polymer.

In a preferred embodiment of the invention, the receiver sheet comprises an opaque substrate. Opacity depends, inter alia, on the film thickness and filler content, but an opaque substrate film will preferably exhibit a Transmission Optical Density (Sakura Densitometer; type PDA 65; transmission mode) of from 0.75 to 1.75, and particularly of from 1.2 to 1.5.

A receiver sheet substrate is conveniently rendered opaque by incorporation into the film-forming synthetic polymer of an effective amount of an opacifying agent. However, in a further preferred embodiment of the invention the opaque substrate is voided, as hereinbefore defined. It is therefore preferred to incorporate into the polymer an effective amount of an agent which is capable of generating an opaque, voided substrate structure. Suitable voiding agents, which also confer opacity, include an incompatible resin filler, a particulate inorganic filler or a mixture of two or more such fillers.

By an "incompatible resin" is meant a resin which either does not melt, or which is substantially immiscible with the polymer, at the highest temperature encountered during extrusion and fabrication of the film. Such resins include polyamides and olefin polymers, particularly a homo- or co-polymer of a mono-alpha-olefin containing up to 6 carbon atoms in its molecule, for incorporation into polyester films, or polyesters of the kind hereinbefore described for incorporation into polyolefin films.

Particulate inorganic fillers suitable for generating an opaque, voided substrate include conventional inorganic pigments and fillers, and particularly metal or metalloid oxides, such as alumina, silica and titania, and alkaline earth metal salts, such as the carbonates and sulphates of calcium and barium. Barium sulphate is a particularly preferred filler which also functions as a voiding agent.

Suitable fillers may be homogeneous and consist essentially of a single filler material or compound, such as titanium dioxide or barium sulphate alone. Alternatively, at least a proportion of the filler may be heterogeneous, the primary filler material being associated with an additional modifying component. For example, the primary filler particle may be treated with a surface modifier, such as a pigment, soap, surfactant, coupling agent or other modifier to promote or alter the degree to which the filler is compatible with the substrate polymer.

Production of a substrate having satisfactory degrees of opacity, voiding and whiteness requires that the filler should be finely-divided, and the average particle size thereof is desirably from 0.1 to 10 μm provided that the actual particle size of 99.9% by number of the particles does not exceed 30 μm. Preferably, the filler has an average particle size of from 0.1 to 1.0 μm, and particularly preferably from 0.2 to 0.75 μm. Decreasing the particle size improves the gloss of the substrate.

Particle sizes may be measured by electron microscope, coulter counter or sedimentation analysis and the average particle size may be determined by plotting a cumulative distribution curve representing the percentage of particles below chosen particle sizes.

It is preferred that none of the filler particles incorporated into the film support according to this invention should have an actual particle size exceeding 30 μm. Particles exceeding such a size may be removed by sieving processes which are known in the art. However, sieving operations are not always totally successful in eliminating all particles greater than a chosen size. In practice, therefore, the size of 99.9% by number of the particles should not exceed 30 μm. Most preferably the size of 99.9% of the particles should not exceed 20 μm.

Incorporation of the opacifying/voiding agent into the polymer substrate may be effected by conventional techniques—for example, by mixing with the monomeric reactants from which the polymer is derived, or by dry blending with the polymer in granular or chip form prior to formation of a film therefrom.

The amount of filler, particularly of barium sulphate, incorporated into the substrate polymer desirably should be not less than 5% nor exceed 50% by weight, based on the weight of the polymer. Particularly satisfactory levels of opacity and gloss are achieved when the concentration of filler is from about 8 to 30%, and especially from 15 to 20%, by weight, based on the weight of the substrate polymer.

Other additives, generally in relatively small quantities, may optionally be incorporated into the film substrate. For example, china clay may be incorporated in amounts of up to 25% to promote voiding, optical brighteners in amounts up to 1500 parts per million to promote whiteness, and dyestuffs in amounts of up to 10 parts per million to modify colour, the specified concentrations being by weight, based on the weight of the substrate polymer.

Thickness of the substrate may vary depending on the envisaged application of the receiver sheet but, in general, will not exceed 250 μm, and will preferably be in a range from 50 to 190 μm, particularly from 145 to 180 μm.

A receiver sheet having a substrate of the kind hereinbefore described offers numerous advantages including (1) a degree of whiteness and opacity essential in the production of prints having the intensity, contrast and feel of high quality art-work, (2) a degree of rigidity and stiffness contributing to improved resistance to surface deformation and image strike-through associated with contact with the print-head and (3) a degree of stability, both thermal and chemical, conferring dimensional stability and curl-resistance.

When TTP is effected directly onto the surface of a voided substrate of the kind hereinbefore described, the optical density of the developed image tends to be low and the quality of the resultant print is generally inferior. A receiving layer is therefore required on at least one surface of the substrate, and desirably exhibits (1) a high receptivity to dye thermally transferred from a donor sheet, (2) resistance to surface deformation from contact with the thermal print-head to ensure the production of an acceptably glossy print, and (3) the ability to retain a stable image.

A receiving layer satisfying the aforementioned criteria comprises a dye-receptive, synthetic thermoplastics polymer. The morphology of the receiving layer may be varied depending on the required characteristics. For example, the receiving polymer may be of an essentially amorphous nature to enhance optical density of the transferred image, essentially crystalline to reduce surface deformation, or partially amorphous/crystalline to provide an appropriate balance of characteristics.

The thickness of the receiving layer may vary over a wide range but generally will not exceed 50 μm. The dry thickness of the receiving layer governs, inter alia, the optical density of the resultant image developed in a particular receiving polymer, and preferably is within a range of from 0.5 to 25 μm. In particular, it has been observed that by careful control of the receiving layer thickness to within a range of from 0.5 to 10 μm, in association with an opaque/voided polymer substrate layer of the kind herein described, a significant improvement in resistance to surface deformation is achieved, without significantly detracting from the optical density of the transferred image.

An antiplasticiser for incorporation into the receiving layer of a sheet according to the present invention suitably comprises an aromatic ester and can be prepared by standard synthetic organic methods, for example by esterification between the appropriate acid and alcohol. The aromatic esters are relatively small molecules, with a molecular weight not exceeding 1000, and more preferably less than 500. The aromatic esters are preferably halogenated, and more preferably chlorinated, although the precise location of the halogenated species within the molecule is not considered to be crucial. The aromatic esters preferably comprise a single independent benzene or naphthalene ring. Examples of suitable non-halogenated aromatic esters include dimethyl terephthalate (DMT) and particularly 2,6 dimethyl naphthalene dicarboxylate (DMN), and suitable chlorinated aromatic esters include tetrachlorophthalic dimethyl ester (TPDE), and particularly hydroquinone dichloromethylester (HQDE) and 2,5 dichloroterephthalic dimethyl ester (DTDE).

A dye-receptive polymer for use in the receiving layer, and offering adequate adhesion to the substrate layer, suitably comprises a polyester resin, particularly a copolyester resin derived from one or more dibasic aromatic carboxylic acids, such as terephthalic acid, isophthalic acid and hexahydroterephthalic acid, and one or more glycols, such as ethylene glycol, diethylene glycol, triethylene glycol and neopentyl glycol. Typical copolyesters which provide satisfactory dye-receptivity and deformation resistance are those of ethylene terephthalate and ethylene isophthalate, especially in the molar ratios of from 50 to 90 mole % ethylene terephthalate and correspondingly from 50 to 10 mole % ethylene isophthalate. Preferred copolyesters comprise from 65 to 85 mole % ethylene terephthalate and from 35 to 15 mole % ethylene isophthalate especially a copolyester of about 82 mole % ethylene terephthalate and about 18 mole % ethylene isophthalate.

The antiplasticiser, such as an aromatic ester, and dye-receptive polymer resin components of a receiving layer of a sheet according to the present invention may be mixed together by any suitable conventional means. For example, the components may be blended by tumble or dry mixing or by compounding—by which is meant melt mixing e.g. on 2-roll mills, in a Banbury mixer or in an extruder, followed by cooling and, usually, comminution into granules or chips.

The ratio of antiplasticiser to polymer should generally be in the range 0.5:99.5 to 30:70% by weight, preferably from 1:99 to 20:80% by weight, and more preferably from 5:95 to 20:80% by weight.

The invention is not limited to the addition of a single antiplasticiser, and, if desired, two or more different antiplasticisers may be added to the polymer of the receiving layer, for example to optimise the observed effect.

The improvement in the optical density of the formed image, both initially and on ageing is attributed to an increase in the barrier properties of the receiving layer of the present invention, and is believed to be due to the suppression of the relaxation peak of the receiving layer polymer, which occurs due to local motion of the polymer molecule. This effect is possibly due to the relatively small antiplasticiser molecules filling up the relatively fixed free volume present in the polymer below its glass transition temperature (Tg), or alternatively because the aromatic ester molecules interact more strongly with adjacent polymer chains, than do the polymer chains with each other. This effect is known as antiplasticisation. The aromatic ester molecules also act as plasticisers, lowering the Tg of the receiving layer polymer. The improvement in barrier properties occurs over the temperature range between the $\beta$ relaxation peak and the Tg of the antiplasticiser/polymer mixture.

Formation of a receiving layer on the substrate layer may be effected by conventional techniques—for example, by casting the polymer onto a preformed substrate layer. Conveniently, however, formation of a composite sheet (substrate and receiving layer) is effected by coextrusion, either by simultaneous coextrusion of the respective film-forming layers through independent orifices of a multi-orifice die, and thereafter uniting the still molten layers, or, preferably, by single-channel coextrusion in which molten streams of the respective polymers are first united within a channel leading to a die manifold, and thereafter extruded together from the die orifice under conditions of streamline flow without intermixing thereby to produce a composite sheet.

A coextruded sheet is stretched to effect molecular orientation of the substrate, and preferably heat-set, as hereinbefore described. Generally, the conditions applied for stretching the substrate layer will induce partial crystallisation of the receiving polymer and it is therefore preferred to heat set under dimensional restraint at a temperature selected to develop the desired morphology of the receiving layer. Thus, by effecting heat-setting at a temperature below the crystalline melting temperature of the receiving polymer and permitting or causing the composite to cool, the receiving polymer will remain essentially crystalline. However, by heat-setting at a temperature greater than the crystalline melting temperature of the receiving polymer, the latter will be rendered essentially amorphous. Heat-setting of a receiver sheet comprising a polyester substrate and a copolyester receiving layer is conveniently effected at a temperature within a range of from 175° to 200° C. to yield a substantially crystalline receiving layer, or from 200° to 250° C. to yield an essentially amorphous receiving layer.

If desired, a receiver sheet according to the invention may be provided with a backing layer on a surface of the substrate remote from the receiving layer, the backing layer comprising a polymeric resin binder and a non-film-forming inert particulate material of mean particle size from 5 to 250 nm. The backing layer thus includes an effective amount of a particulate material to improve the slip, antiblocking and general handling characteristics of the sheet. Such a slip agent may comprise any particulate material which does not film-form during film processing subsequent to formation of the backing layer, for example—an inorganic material such as silica, alumina, china clay and calcium carbonate, or an organic polymer having a high glass transition temperature (Tg≧75° C.), for example—polymethyl methacrylate or polystyrene. The preferred slip agent is silica which is preferably employed as a colloidal sol, although a colloidal alumina sol is also suitable. A mixture of two or more particulate slip agents may be employed, if desired.

The mean particulate size, measured—for example, by photon correlation spectroscopy, of the slip agent is from 5 to 250 nanometres (nm) preferably from 5 to 150 nm. Particularly desirable sheet feeding behaviour is observed when the slip agent comprises a mixture of small and large particles within the size range of from 5 to 150 nm, particularly a mixture of small particles of average diameter from 5 to 50 nm, preferably from 20 to 35 nm, and large particles of average diameter from 70 to 150 nm, preferably from 90 to 130 nm.

The amount of slip additive is conveniently in a range of from 5 to 50%, preferably from 10 to 40%, of the dry weight of the backing layer. When particles of mixed sizes are employed, the weight ratio of small:large particles is suitably from 1:1 to 5:1, particularly from 2:1 to 4:1.

The thickness of the backing layer may extend over a considerable range, depending on the type of printer and print-head to be employed, but generally will be in a range of from 0.005 to 10 μm. Particularly effective sheet-feeding behaviour is observed when at least some of the slip particles protrude from the free surface of the backing layer. Desirably, therefore, the thickness of the backing layer is from about 0.01 to 1.0 μm, particularly from 0.02 to 0.1 μm.

The polymeric binder resin of the backing layer may be any polymer known in the art to be capable of forming a continuous, preferably uniform, film, to be resistant to the temperature encountered at the print-head and, preferably, to exhibit optical clarity and be strongly adherent to the supporting substrate.

Suitable polymeric binders include:

(a) "aminoplast" resins which can be prepared by the interaction of an amine or amide with an aldehyde, typically an alkoxylated condensation product of melamine and formaldehyde, e.g. hexamethoxymethylmelamine;

(b) homopolyesters, such as polyethylene terephthalate;

(c) copolyesters, particularly those derived from a sulpho derivative of a dicarboxylic acid such as sulphoterephthalic acid and/or sulphoisophthalic acid;

(d) copolymers of styrene with one or more ethylenically unsaturated comonomers such as maleic anhydride or itaconic acid, especially the copolymers described in British patent specification GB-A-1540067; and particularly (e) copolymers of acrylic acid and/or methacrylic acid and/or their lower alkyl (up to 6 carbon atoms) esters, e.g. copolymers of ethyl acrylate and methyl methacrylate, copolymers of methyl methacrylate/-butyl acrylate/acrylic acid typically in the molar proportions 55/27/18% and 36/24/40%, and especially copolymers containing hydrophilic functional groups, such as copolymers of methyl methacrylate and methacrylic acid, and cross-linkable copolymers, e.g. comprising approximate molar proportions 46/46/8% respectively of ethyl acrylate/methyl methacrylate/acrylamide or methacrylamide, the latter polymer being particularly effective when thermoset—for example, in the presence of about 25 weight % of a methylated melamine formaldehyde resin.

Formation of the backing layer may be effected by techniques known in the art, the layer being conveniently applied to the supporting substrate from a coating composition comprising a solution or dispersion of the resin and slip agent in a volatile medium.

Aqueous coating media may be employed provided the polymeric binder is capable of film formation into a continuous uniform coating, generally when applied from an aqueous dispersion or latex, and this medium is particularly suitable for the formation of an acrylic or methacrylic backing layer.

Alternatively, the volatile liquid medium is a common organic solvent or a mixture of solvents in which the polymeric binder is soluble and is also such that the slip particles do not precipitate from the coating composition. Suitable organic solvents include methanol, acetone, ethanol, diacetone alcohol and 2-methoxy ethanol. Minor amounts of other solvents such as methylene chloride and methyl ethyl ketone may also be used in admixture with such solvents.

The adhesion of a coating composition to the substrate may be improved, if appropriate, by the addition of a known adhesion-promoting agent. The "aminoplast" resins (a) described above are particularly suitable for addition as adhesion-promoting agents. Such agents may be cross-linked if desired by the addition of a cross-linking catalyst and heating to initiate the cross-linking reaction after the application of the coating composition to the substrate surface.

Formation of a backing layer by application of a liquid coating composition may be effected at any convenient stage in the production of the receiver sheet. For example, it is preferred, particularly in the case of a polyester film substrate, the formation of which involves relatively high extrusion and/or treatment temperatures, to deposit the backing layer composition directly onto a surface of a preformed film substrate. In particular, it is preferred to apply the backing composition as an inter-draw coating between the two stages (longitudinal and transverse) of a biaxial film stretching operation.

The applied coating medium is subsequently dried to remove the volatile medium and, if appropriate, to effect cross-linking of the binder components. Drying may be effected by conventional techniques—for example, by passing the coated film substrate through a hot air oven. Drying may, of course, be effected during normal post-formation film-treatments, such as heat-setting.

If desired, a receiver sheet according to the invention may additionally comprise an antistatic layer. Such an antistatic layer is conveniently provided on a surface of the substrate remote from the receiving layer, or, if a backing layer is employed on the free surface of the backing layer remote from the receiving layer. Although a conventional antistatic agent may be employed, a polymeric antistat is preferred. A particularly suitable polymeric antistat is that described in our copending British patent application No. 8815632.8 the disclosure of which is incorporated herein by reference, the antistat comprising (a) a polychlorohydrin ether of an ethoxylated hydroxyamine and (b) a polyglycol diamine, the total alkali metal content of components (a) and (b) not exceeding 0.5% of the combined weight of (a) and (b).

In a preferred embodiment of the invention a receiver sheet is rendered resistant to ultra-violet (UV) radiation by incorporation of a UV stabiliser. Although the stabiliser may be present in any of the layers of the receiver sheet, it is preferably present in the receiving layer. The stabiliser may comprise an independent additive or, preferably, a copolymerised residue in the chain of the receiving polymer. In particular, when the receiving polymer is a polyester, the polymer chain conveniently comprises a copolymerised esterification residue of an aromatic carbonyl stabiliser. Suitably, such esterification residues comprise the residue of a di(hydroxyalkoxy)coumarin—as disclosed in European Patent Publication EP-A-31202, the residue of a 2-hydroxy-di(hydroxyalkoxy)benzophenone—as disclosed in EP-A-31203, the residue of a bis(hydroxyalkoxy)xanth-9-one—as disclosed in EP-A-6686, and, particularly preferably, a residue of a hydroxy-bis(hydroxyalkoxy)-xanth-9-one—as disclosed in EP-A-76582. The alkoxy groups in the aforementioned stabilisers conveniently contain from 1 to 10 and preferably from 2 to 4 carbon atoms, for example—an ethoxy group. The content of esterification residue is conveniently from 0.01 to 30%, and preferably from 0.05 to 10%, by weight of the total receiving polymer. A particularly preferred residue is a residue of a 1-hydroxy-3,6-bis(hydroxyalkoxy)xanth-9-one.

A receiver sheet in accordance with the invention may, if desired, comprise a release medium present either within the receiving layer or, preferably, as a discrete layer on at least part of the exposed surface of the receiving layer remote from the substrate.

The release medium, if employed, should be permeable to the dye transferred from the donor sheet, and comprises a release agent—for example, of the kind conventionally employed in TTP processes to enhance the release characteristics of a receiver sheet relative to a donor sheet. Suitable release agents include solid waxes, fluorinated polymers, silicone oils (preferably cured) such as epoxy- and/or amino-modified silicone oils, and especially organopolysiloxane resins. An organopolysiloxane resin is particularly suitable for application as a discrete layer on at least part of the exposed surface of the receiving layer.

The release medium may, if desired, additionally comprise a particulate adjuvant. Suitably, the adjuvant comprises an organic or an inorganic particulate material having an average particle size not exceeding 0.75 μm and being thermally stable at the temperatures encountered during the TTP operation.

The amount of adjuvant required in the release medium will vary depending on the required surface characteristics, and in general will be such that the weight ratio of adjuvant to release agent will be in a range of from 0.25:1 to 2.0:1.

To confer the desired control of surface frictional characteristics the average particle size of the adjuvant should not exceed 0.75 μm. Particles of greater average size also detract from the optical characteristics, such as haze, of the receiver sheet. Desirably, the average particle size of the adjuvant is from 0.001 to 0.5 μm, and preferably from 0.005 to 0.2 μm.

The required frictional characteristics of the release medium will depend, inter alia, on the nature of the compatible donor sheet employed in the TTP operation, but in general satisfactory behaviour has been observed with a receiver and associated release medium which confers a surface coefficient of static friction of from 0.075 to 0.75, and preferably from 0.1 to 0.5.

The release medium may be blended into the receiving layer in an amount up to about 50% by weight thereof, or applied to the exposed surface thereof in an appropriate solvent or dispersant and thereafter dried, for example—at temperatures of from 100° to 160° C., preferably from 100° to 120° C., to yield a cured release layer having a dry thickness of up to about 5 μm, preferably from 0.025 to 2.0 μm. Application of the release medium may be effected at any convenient stage in the production of the receiver sheet. Thus, if the substrate of the receiver sheet comprises a biaxially oriented polymeric film, application of a release medium to the surface of the receiving layer may be effected off-line to a post-drawn film, or as an in-line inter-draw coating applied between the forward and transverse film-drawing stages.

If desired, the release medium may additionally comprise a surfactant to promote spreading of the medium and to improve the permeability thereof to dye transferred from the donor sheet.

A release medium of the kind described yields a receiver sheet having excellent optical characteristics, devoid of surface blemishes and imperfections, which is permeable to a variety of dyes, and confers multiple, sequential release characteristics whereby a receiver sheet may be successively imaged with different monochrome dyes to yield a full coloured image. In particular, register of the donor and receiver sheets is readily maintained during the TTP operation without risk of wrinkling, rupture or other damage being sustained by the respective sheets.

The invention is illustrated by reference to the accompanying drawings in which:

FIG. 1 is a schematic elevation (not to scale) of a portion of a TTP receiver sheet 1 comprising a polymeric supporting substrate 2 having, on a first surface thereof, a dye-receptive receiving layer 3 and, on a second surface thereof, a backing layer 4, FIG. 2 is a similar, fragmentary schematic elevation in which the receiver sheet comprises an independent release layer 5, FIG. 3 is a schematic, fragmentary elevation (not to scale) of a compatible TTP donor sheet 6 comprising a polymeric substrate 7 having on one surface (the front surface) thereof a transfer layer 8 comprising a sublimable dye in a resin binder, and on a second surface (the rear surface) thereof a polymeric protective layer 9.

Figure 1:
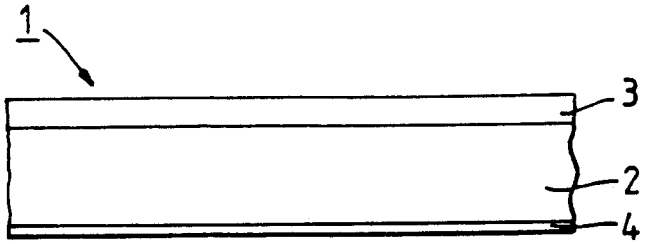
Figure 2:
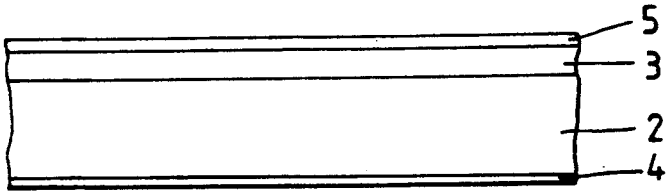
Figure 3:
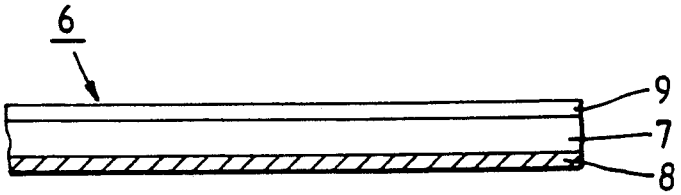
Figure 4:
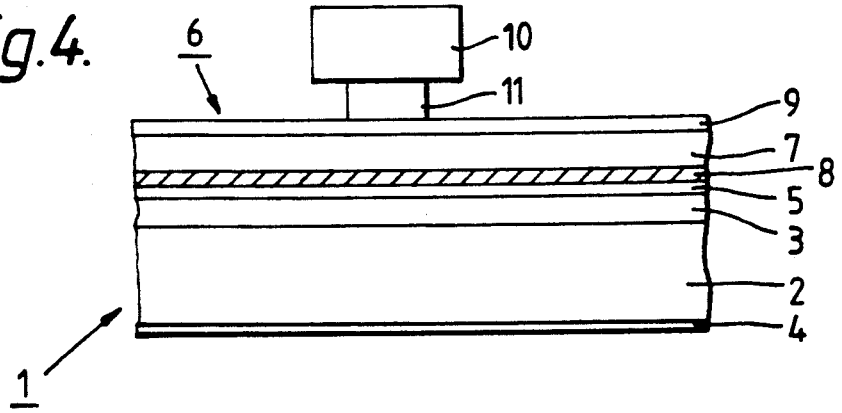
FIG. 4 is a schematic elevation of a TTP process.
Figure 5:
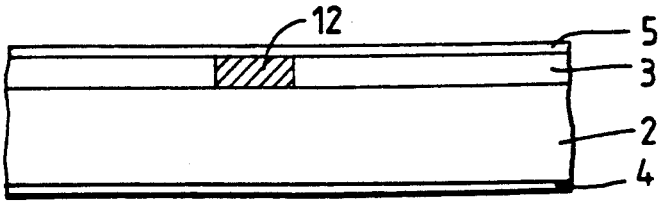
FIG. 5 is a schematic elevation of an imaged receiver sheet.

Referring to the drawings, and in particular to FIG. 4, a TTP process is effected by assembling a donor sheet and a receiver sheet with the respective transfer layer 8 and a release layer 5 in contact. An electrically-activated thermal print-head 10 comprising a plurality of print elements 11 (only one of which is shown) is then placed in contact with the protective layer of the donor sheet. Energisation of the print-head causes selected individual print-elements 11 to become hot, thereby causing dye from the underlying region of the transfer layer to sublime through dye-permeable release layer 5 and into receiving layer 3 where it forms an image 12 of the heated element(s). The resultant imaged receiver sheet, separated from the donor sheet, is illustrated in FIG. 5 of the drawings.

By advancing the donor sheet relative to the receiver sheet, and repeating the process, a multi-colour image of the desired form may be generated in the receiving layer.

The invention is further illustrated by reference to the following Examples.

EXAMPLE 1

A TTP receiver sheet was formed as follows.

Hydroquinone dichloromethyl ester

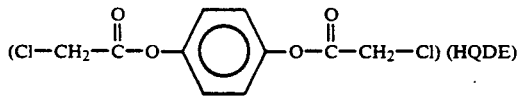

was prepared by adding thionyl chloride dropwise to chloroacetic acid, followed by the addition of hydroquinone. The mixture was heated, and sodium bicarbonate added. Once effervescence had ceased, isopropanol was added, the mixture heated, and white crystals of the product extracted.

8 g of HQDE was mixed with 92 g of a copolyester comprised of 65 mole % ethylene terephthalate and 35 mole % ethylene isophthalate. This mixture was dissolved in chloroform to form a 5% by weight solution. This solution was coated onto a 175 μm thick A4 sheet of biaxially stretched polyethylene terephthalate containing 18% by weight, based on the weight of the polymer, of a finely divided particulate barium sulphate filler having an average particle size of 0.5 μm. The solution was coated to yield a nominal dry coat thickness of 2.5 μm. After the chloroform solvent had evaporated, the coated polyethylene terephthalate sheet was placed in an oven at 120° C. for 30 seconds.

The printing characteristics of the above formed receiver sheet were assessed using a donor sheet comprising a biaxially oriented polyethylene terephthalate substrate of about 6 μm thickness having on one surface thereof a transfer layer of about 2 μm thickness comprising a cyan dye in a cellulosic resin binder.

A sandwich comprising a sample of the donor and receiver sheets with the respective transfer and receiving layers in contact was placed on the rubber covered drum of a thermal transfer printing machine and contacted with a print head comprising a linear array of pixcels spaced apart at a linear density of 6/mm. On selectively heating the pixcels in accordance with a pattern information signal to a temperature of about 350° C. (power supply 0.32 watt/pixcel) for a period of 10 milliseconds (ms), cyan dye was transferred from the transfer layer of the donor sheet to form a corresponding image of the heated pixcels in the receiving layer of the receiver sheet. The reflective optical density (ROD) of the formed image was measured.

The above printing procedure was repeated on additional samples of receiver sheet with printing times of 9, 8 and 7 ms.

The results are shown in Table 1. ROD results given are the mean values of ten readings.

EXAMPLE 2

This is a comparative example not according to the invention.

The procedure of Example 1 was repeated except that no HQDE was added to the copolyester.

Mean values of 10 ROD readings are shown in Table 1.

EXAMPLE 3

The procedure of Example 1 was repeated except that the printed receiver sheets were aged by placing them in an oven at 40° C. for 400 hours before measuring the ROD's. Mean values of 10 readings were calculated. Results are shown in Table 1.

EXAMPLE 4

This is a comparative example not according to the invention.

The procedure of Example 2 was repeated except that the printed receiver sheets were aged by placing them in an oven at 40° C. for 400 hours before measuring the ROD's. Mean values of 10 readings were again calculated, and the results shown in Table 1.

TABLE 1

| | Reflective Optical Density (ROD) | | | |
|---|---|---|---|---|
| | Print Time (ms) | | | |
| Example No | 10 | 9 | 8 | 7 |
| 1 | 2.03 | 1.70 | 1.37 | 1.02 |
| 2 (Comparative) | 1.89 | 1.58 | 1.24 | 0.93 |
| *3 | 1.99 | 1.68 | 1.36 | 1.01 |
| *4 (Comparative) | 1.85 | 1.53 | 1.21 | 0.91 |

*After ageing

EXAMPLES 5-10

The procedures of Examples 1 and 3 were repeated except that the concentration of HQDE in the copolyester layer was reduced from 8 to 6, 4 and 2% by weight respectively of the total coating material. Mean values of 10 ROD reading were calculated and are given in Table 2. Examples 5, 7 and 9 give the original ROD values, and Examples 6, 8 and 10 the ROD values after ageing in an oven at 40° C. for 400 hours.

TABLE 2

| | Reflective Optical Density (ROD) | | | | |
|---|---|---|---|---|---|
| | Print Time (ms) | | | | HQDE concentration |
| Example No | 10 | 9 | 8 | 7 | (% by weight) |
| 5 | 1.93 | 1.63 | 1.27 | 0.95 | 2 |
| *6 | 1.87 | 1.57 | 1.19 | 0.92 | 2 |
| 7 | 1.98 | 1.66 | 1.32 | 0.99 | 4 |
| *8 | 1.88 | 1.60 | 1.25 | 0.95 | 4 |
| 9 | 2.02 | 1.70 | 1.35 | 1.01 | 6 |

TABLE 2-continued

| | Reflective Optical Density (ROD) | | | | |
|---|---|---|---|---|---|
| | Print Time (ms) | | | | HQDE concentration |
| Example No | 10 | 9 | 8 | 7 | (% by weight) |
| *10 | 1.90 | 1.64 | 1.30 | 0.98 | 6 |

*After ageing

EXAMPLES 11-18

The procedure of Example 1 was repeated except that a magenta dyesheet was used instead of a cyan dyesheet, and the amount of HQDE in the copolyester layer was varied from 2 to 20% by weight of the total coating material. Mean values of 10 ROD readings were calculated and the results are given in Table 3.

EXAMPLE 19

This is a comparative example not according to the invention.

The procedure of Example 2 was repeated except that a magenta dyesheet was used instead of a cyan dyesheet. Mean values of 10 ROD readings were calculated and the results are given in Table 3.

TABLE 3

| | Reflective Optical Density (ROD) | | | | |
|---|---|---|---|---|---|
| | Print Time (ms) | | | | HQDE concentration |
| Example No | 10 | 9 | 8 | 7 | (% by weight) |
| 11 | 2.13 | 1.83 | 1.53 | 1.18 | 2 |
| 12 | 2.09 | 1.83 | 1.49 | 1.17 | 4 |
| 13 | 2.23 | 1.93 | 1.56 | 1.26 | 8 |
| 14 | 2.26 | 1.96 | 1.66 | 1.30 | 10 |
| 15 | 2.30 | 2.02 | 1.70 | 1.35 | 12.5 |
| 16 | 2.38 | 2.10 | 1.79 | 1.43 | 15 |
| 17 | 2.38 | 2.13 | 1.79 | 1.47 | 17.5 |
| 18 | 2.43 | 2.20 | 1.91 | 1.56 | 20 |
| 19 (Comparative) | 2.05 | 1.81 | 1.51 | 1.17 | 0 |

EXAMPLES 20-22

The procedure of Example 1 was repeated except that 10 g of 2,6 dimethyl naphthalene dicarboxylate (DMN) was mixed with 90 g of the copolyester, for coating onto polyethylene terephthalate film. The donor dye sheets used were cyan, magenta and yellow respectively.

Mean valves of 10 ROD readings are given in Table 4.

EXAMPLES 23-25

These are comparative examples not according to the invention.

The procedure of Examples 20-22 was repeated except that no DMN was added to the polyester.

Mean values of 10 ROD readings are given in Table 4.

EXAMPLES 26-28

The procedure of Examples 20-22 was repeated except that the printed receiver sheets were aged by placing them in an oven at 40° C. for 400 hours before measuring the ROD's. Mean values of 10 readings were calculated. Results are shown in Table 4.

EXAMPLES 29-31

These are comparative examples not according to the invention.

The procedure of Examples 23-25 was repeated except that the printed receiver sheets were aged by placing them in an oven at 40° C. for 400 hours before measuring the ROD's. Mean values of 10 readings were calculated. Results are shown in Table 4.

TABLE 4

| Example No | Dyesheet | Print Time (ms) 10 | 9 | 8 | 7 | DMN concentration (% by weight) |
|---|---|---|---|---|---|---|
| 20 | Cyan | 2.10 | 1.85 | 1.51 | 1.15 | 10 |
| 21 | Magenta | 2.29 | 2.03 | 1.73 | 1.37 | 10 |
| 22 | Yellow | 2.47 | 2.37 | 2.23 | 1.83 | 10 |
| 23 (Comparative) | Cyan | 1.89 | 1.58 | 1.24 | 0.93 | 0 |
| 24 (Comparative) | Magenta | 2.05 | 1.81 | 1.51 | 1.17 | 0 |
| 25 (Comparative) | Yellow | 2.41 | 2.25 | 2.04 | 1.75 | 0 |
| *26 | Cyan | 2.07 | 1.90 | 1.50 | 1.13 | 10 |
| *27 | Magenta | 2.22 | 2.01 | 1.69 | 1.33 | 10 |
| *28 | Yellow | 2.40 | 2.30 | 2.13 | 1.79 | 10 |
| *29 (Comparative) | Cyan | 1.85 | 1.53 | 1.21 | 0.91 | 0 |
| *30 (Comparative) | Magenta | 2.05 | 1.75 | 1.50 | 1.17 | 0 |
| *31 (Comparative) | Yellow | 2.31 | 2.22 | 1.97 | 1.68 | 0 |

*After Ageing

The results in Tables 1-4 show the improvement in initial ROD's obtained by use of the present invention. This improvement in the intensity of the image is maintained even after ageing of the printed sheet.

We claim:

1. A thermal transfer printing receiver sheet for use in association with a compatible donor sheet, the receiver sheet comprising a supporting substrate having, on at least one surface thereof, a dye-receptive receiving layer to receive a dye thermally transferred from the donor sheet, characterized in that the receiving layer comprises a dye-receptive polymer and from 0.5% to 30% by weight of the layer of at least one antiplasticiser therefor wherein said antiplasticiser comprises at least one aromatic ester of molecular weight not exceeding 1,000 and said dye-receptive polymer comprises a polyester.

2. A receiver sheet according to claim 1 wherein the aromatic ester comprises a single independent benzene or naphthalene ring.

3. A receiver sheet according to claim 2 wherein the aromatic ester comprises at least one halogen atom.

4. A receiver sheet according to claim 3 wherein the halogen atom is a chlorine atom.

5. A receiver sheet according to claim 1 wherein the dye-receptive polymer comprises a copolyester.

6. A receiver sheet according to claim 5 wherein the copolyester comprises a copolymer of ethylene terephthalate and ethylene isophthalate.

7. A receiver sheet according to claim 1 wherein the substrate is an oriented polyester film.

8. A method of producing a thermal transfer printing receiver sheet having a supporting substrate and a dye-receiving layer for use in association with a compatible donor sheet, comprising forming the supporting substrate, and forming the dye-receiving layer so that said dye-receiving layer is supported by said substrate when in a position associated with said donor sheet to receive a dye thermally transferred from the donor sheet, and wherein said receiving layer comprises a dye-receptive polymer and from 0.5% to 30% by weight of the dye-receiving layer of at least one antiplasticiser therefor, said antiplasticiser comprising at least one aromatic ester of molecular weight not exceeding 1,000.

* * * * *